US007384048B2

(12) United States Patent
Cerrito

(10) Patent No.: US 7,384,048 B2
(45) Date of Patent: Jun. 10, 2008

(54) ROTATABLE BINDING APPARATUS FOR A SNOWBOARD

(75) Inventor: Paul Cerrito, 189 42nd St., Lindenhurst, NY (US) 11757

(73) Assignee: Paul Cerrito, Sayville, NY (US)

( * ) Notice: Subject to any disclaimer, the term of this patent is extended or adjusted under 35 U.S.C. 154(b) by 82 days.

(21) Appl. No.: 11/364,314

(22) Filed: Feb. 28, 2006

(65) Prior Publication Data

US 2007/0200306 A1 Aug. 30, 2007

(51) Int. Cl.
*B62B 13/00* (2006.01)

(52) U.S. Cl. ..... 280/14.22; 280/14.21; 280/14.23; 280/14.24

(58) Field of Classification Search ..... 280/14.24, 280/14.21, 14.23, 607, 618, 617, 613, 636, 280/623, 14.22, 14.25, 614, 616, 634, 620, 280/633

See application file for complete search history.

(56) References Cited

U.S. PATENT DOCUMENTS

| | | | | | |
|---|---|---|---|---|---|
| 5,236,216 | A | * | 8/1993 | Ratzek | 280/607 |
| 5,261,689 | A | * | 11/1993 | Carpenter et al. | 280/618 |
| 5,354,088 | A | | 10/1994 | Vetter et al. | |
| 5,499,837 | A | | 3/1996 | Hale et al. | |
| 5,553,883 | A | | 9/1996 | Erb | |
| 5,577,755 | A | | 11/1996 | Metzger et al. | |
| 5,667,237 | A | | 9/1997 | Lauer | |
| 5,732,959 | A | | 3/1998 | Soejima | |
| 5,782,476 | A | | 7/1998 | Fardie | |
| 5,791,678 | A | | 8/1998 | Perlman | |
| 5,820,139 | A | * | 10/1998 | Grindl | 280/14.24 |
| 5,868,416 | A | * | 2/1999 | Fardie | 280/607 |
| 5,890,729 | A | | 4/1999 | Bayer et al. | |
| 5,897,128 | A | | 4/1999 | McKenzie | |
| 5,909,893 | A | * | 6/1999 | Keller et al. | 280/607 |
| 5,909,894 | A | * | 6/1999 | Meader et al. | 280/623 |
| 5,913,530 | A | * | 6/1999 | Berger et al. | 280/607 |
| 5,915,718 | A | * | 6/1999 | Dodge | 280/607 |
| 5,947,488 | A | | 9/1999 | Gorza et al. | |
| 6,062,584 | A | | 5/2000 | Sabol | |
| 6,065,768 | A | * | 5/2000 | Lee | 280/613 |
| 6,102,430 | A | * | 8/2000 | Reynolds | 280/618 |
| 6,155,578 | A | * | 12/2000 | Patterson | 280/14.24 |
| 6,155,591 | A | * | 12/2000 | Huffman et al. | 280/618 |
| 6,203,051 | B1 | * | 3/2001 | Sabol | 280/607 |
| 6,206,402 | B1 | | 3/2001 | Tanaka | |
| 6,318,749 | B1 | | 11/2001 | Eglitis et al. | |
| 6,450,511 | B1 | | 9/2002 | LaVoy | |
| 6,575,489 | B1 | | 6/2003 | White | |
| 2005/0029757 | A1 | | 2/2005 | Fiebing | |
| 2005/0051978 | A1 | | 3/2005 | Sabol | |

* cited by examiner

*Primary Examiner*—Hau V Phan
(74) *Attorney, Agent, or Firm*—James V. Costigan; Hedman & Costigan, P.C.

(57) ABSTRACT

A binding for affixing a boot to a snowboard that is being adapted to rotate between a plurality of fixed positions and having.

(a) a first plate having plurality of holes between the top and bottom surfaces sized to engage fasteners. The first circular plate has a flange which mates with a flange on a second circular plate. The second plate has a centrally located hole that is sized to receive the first circular plate and having adjacent to the hole, a flange which is complimentary to the flange on the first plate. A third plate having a diameter which is substantially the same as the diameter of the second plate and which has a plurality of holes which are registerable with holes in the first plate. The third plate has a plurality of positions of the second plate relative to a longitudinal axis of a snowboard.

9 Claims, 8 Drawing Sheets

ROTATABLE BINDING APPARATUS FOR A SNOWBOARD

BACKGROUND OF INVENTION

1) Field of Invention

This invention relates to a rotatable apparatus for snowboard bindings. It specifically relates to a simple binding that allows the front binding on a snowboard to swivel, without removing that front boot from the binding, and lock at pre-selected positions.

2) Description of Prior Art

In recent years, the sport of snowboarding has been growing in popularity. If this growth rate continues, snowboarding has the possibility of going past the popularity of downhill skiing. Young children are choosing snowboarding rather than downhill skiing as a beginning point for winter sports. Skateboarders of all ages are transferring their skills to the snowboard when they have the opportunity. Many skiers are even attempting to make the change to the newer, exciting sport of snowboarding. A snowboard is like a wide ski on which both feet are held to the board by two bindings that are set in a side-forward (transverse) stance. This stance is needed for performance in downhill boarding to control the snowboard and maneuver it as gravity pulls the board down the slope. There are periods when this side-forward (transverse) position becomes a problem for the snowboarder. When there is none or little pull from gravity, they find it necessary to disengage one boot from its binding, usually the back boot. With this free boot, they can propel their snowboard forward by using "skateboard style". The remaining boot is left on the snowboard in the side-forward transverse position. The snowboarder's body is left in an awkward, uncomfortable and twisted position as he or she attempts to move through flat terrain, and move onto the chairlift. They even keep this position as the snowboard hangs from that boot on the chairlift in the side forward (transverse) position. A rider can be on a chairlift longer than 15 minutes and this position can interfere with others on the chairlift as well as causing much strain and stress on the snowboarder's knee, leg, thigh and hip that are left in that side-forward position.

A solution to this problem is to allow that forward boot to be easily and quickly swiveled and locked to a predetermined position using a minimum of physical effort. Ideally this should be done without the use of tools and the locked positions should have a minimum of free-play in order to allow for maximum control of the snowboard under stressful operation conditions. The use of tools for adjusting the position should be avoided to maximize the speed and ease of carrying out the swiveling operation.

U.S. Pat. No. 5,236,216 discloses a fastening disc that is bolted to the snowboard and rotation of the binding is controlled by loosening and tightening the bolts.

U.S. Pat. No. 5,577,755 provides a structure for making a rotating snowboard binding where the binding has a top and bottom plate which are affixed to one another and to the snowboard.

The previous attempts to address the need to move the position of the boot have generally involved complicated structures which did not result in a rotating binding that was relatively free of vibration during use, was not easy to operate and had disadvantages.

The present invention provides a rotatable assembly for a snowboard binding that is simple to manufacture, has three plates, a lock block a locking mechanism and a leash. It is designed to avoid any structure which would accumulate excessive amounts of ice, snow and/or dirt.

SUMMARY OF THE INVENTION

The invention provides a binding that is adapted to affix a boot to a snowboard. The binding is designed to rotate between a plurality of fixed positions and comprises:

(a) a first circular plate having a top surface and a bottom surface and having a plurality of holes between said top surface and said bottom surface which are sized to engage fasteners, said first circular plate having on its upper surface a section of reduced thickness adjacent to its outer circular edge which defines a relatively thicker central section of said first circular plate;

(b) a second circular plate adapted to be fastened to the top surface of a snowboard, said second circular plate having a top surface and a bottom surface and a centrally located hole that is sized to receive said first circular plate and having adjacent to said hole, a section of reduced thickness on its lower surface which is sized to engage the section of reduced thickness on said first circular plate while allowing rotation of said first circular plate relative to said second circular plate;

(c) a third circular plate having a diameter which is substantially the same as the diameter of said second circular plate, said third circular plate having a plurality of holes which are positionable to be in register with said plurality of holes in said first circular plate, said third circular plate having means to releasably engage stopping means on the upper surface of said second circular plate to allow for selection of a plurality of positions of said third plate relative to a longitudinal axis of a snowboard; and (d) means for fastening said first circular plate to said third circular plate.

It is a primary object of the invention to provide a snowboard binding mount that allows the boot binding of the front foot to be easily swiveled from a firmly fixed side forward (transverse) position to a firmly fixed toe forward (longitudinally aligned) position on the snowboard.

It is also an object of the invention to provide a snowboard binding mount that allows the boot binding of the front foot to be easily swiveled while providing a stable, substantially vibration free operation during active use.

It is also an object of the invention to provide multiple locking elements that may be simultaneously operated with one hand, without any tools, to allow for unlocking and relocking the rotating elements of the binding.

It is also an object of the invention to reduce the risk of harm to the legs, knees, muscles and joints of the user of the snowboard by providing an improved rotating device for a snowboard binding for avoiding the need to remove a boot from a binding in order to avoid having to keep the leg bent in an unnatural position.

It is also an object of the invention to provide a binding which can be retro-fit to a conventional snowboard without any drilling of the board.

It is also an object of the invention to prevent or reduce excessive toe and heel drag that may occur when boots hang over the edge of the snowboard.

These and other objects of the invention will become apparent from a review of the drawings and the specifications.

DETAILED DESCRIPTION OF THE INVENTION

Figure 6:
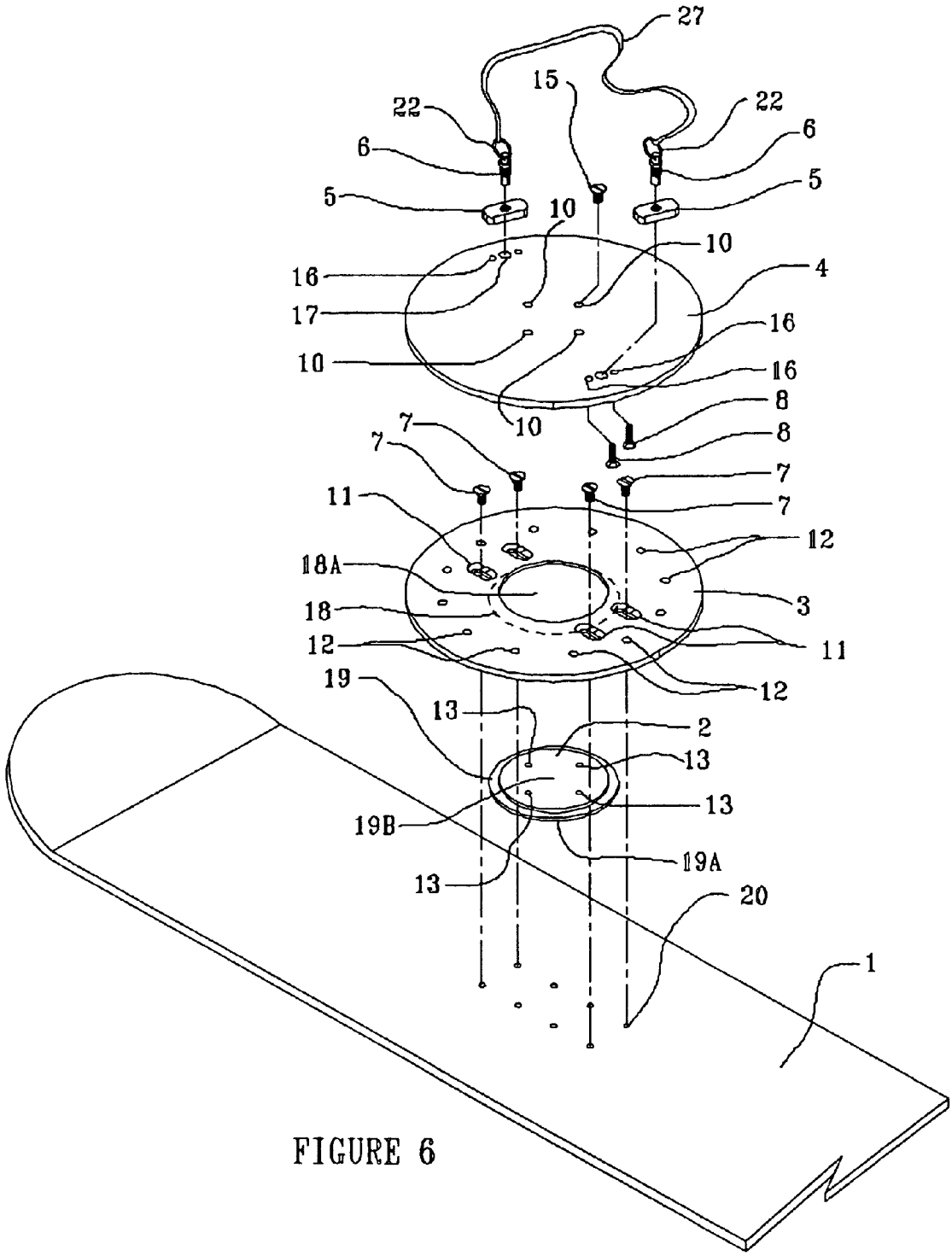
FIG. 6 is an exploded view of an embodiment of the present invention showing the elements of the snowboard binding relative to its mounting position on a snowboard.
Figure 7:
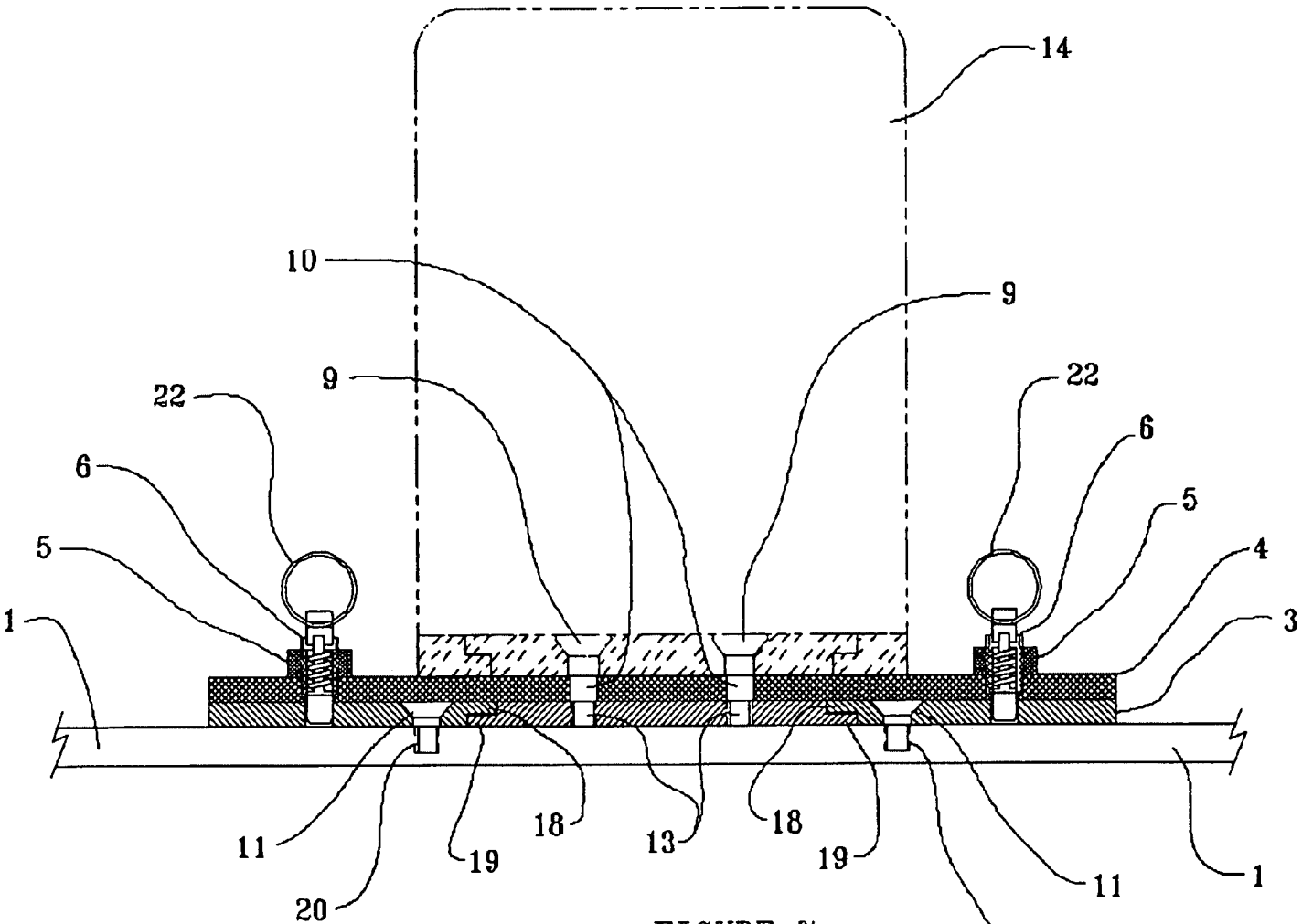
FIG. 7 is a cross-sectional view of an embodiment of the present invention taken along line 7-7 of FIG. 5.

When a snowboarder removes the back boot from its binding to push the snowboard along a surface, the snowboarder can operate the rotatable binding of the invention by disengage the locking pins 6 in lock blocks 5 by pulling on pull cord or leash 27 as shown in FIG. 6. While the locking pins are disengaged, the binding mount of the front boot is rotated to position the boot in a toe-forward position. This toe-forward position prevents the thigh, the knee, the ankle and the associated muscles and ligaments from being subjected to an unnatural stress when the snowboard is pushed forward in a "skateboarding style". When the snowboarder reaches a desired location for downhill boarding, pull cord 27 is retracted to withdraw locking pins 6 to permit the rotatable binding to be rotated to the side forward or transverse position.

The first circular plate 2 functions as a swivel plate as it is not attached to the snowboard. The first circular plate 2 has on its upper surface a section of reduced thickness or lower flange 19 which is adjacent to its outer circular edge 19A. Central section 19B of the first circular plate 2 has a relatively thicker central section 19B as compared to the section having a reduced thickness or lower flange 19. The second circular plate 3 is the part of the snowboard binding that is adapted to be fastened to the surface of a snowboard using slots 11. The second circular plate 3 has a centrally located hole 18A that is sized to receive the central portion 19B of the first circular plate 2 and has adjacent to said centrally located hole 18A, an area that has a reduced thickness which forms upper flange 18. The central portion 19B is sized to engage the section of reduced thickness or flange 19 on said first circular plate 2 while allowing rotation of said first circular plate 2 relative to said second circular plate 3. The upper and lower flange sections 18 and 19 are sized to mate with each other. Suitable lubricants may be used to facilitate rotation where the flanged section contact one another.

The first circular plate 2 and the second circular plate 3 are preferably made of stock having the same thickness so that slightly less than about one-half of the thickness may be removed from each of the first and second circular plates to allow flange 19 to mate with flange 18 and to allow the first circular plate 2 to rotate under the second circular plate 3 when the second circular plate 3 is mounted on the snowboard. This design also provides a low profile for the binding which although it has three plates, the thickness of the binding is limited to the thickness of two of the plates when a preferred embodiment utilizes plates of equal thickness. The flat surfaces and the diameters of lower flange 19 and upper flange 18 are preferably closely fitted in order to minimize vibration or undesired side to side movement. In the alternative, lower flange 19 and upper flange 18 may be provided with complimentary sloped surfaces to further minimize movement or vibration when the snowboard is stressed under operating conditions. The cord or leash 27 is used to pull the locking pins 6 and allow the rider to stay more upright and permits the pins to be moved without removal of gloves.

The plates and all of the components are preferably made of aluminum or an aluminum alloy having high tensile strength and corrosion resistance. Stainless steel or composite materials may also be used to make the plates.

Figure 1:
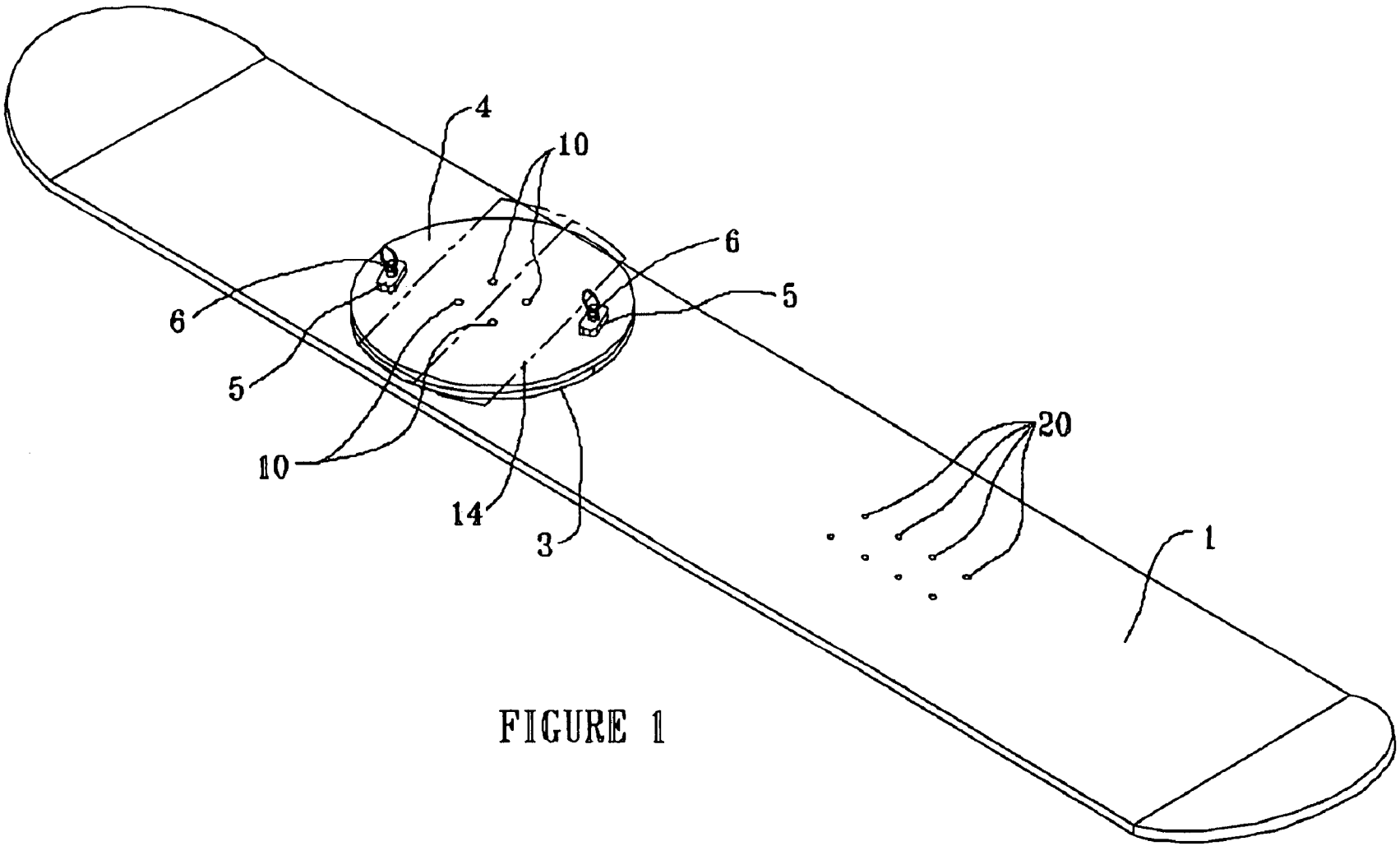
FIG. 1 is a top perspective view of a snowboard where an embodiment of the present invention is shown mounted to the top surface of a snowboard in an operable position.
Figure 3:
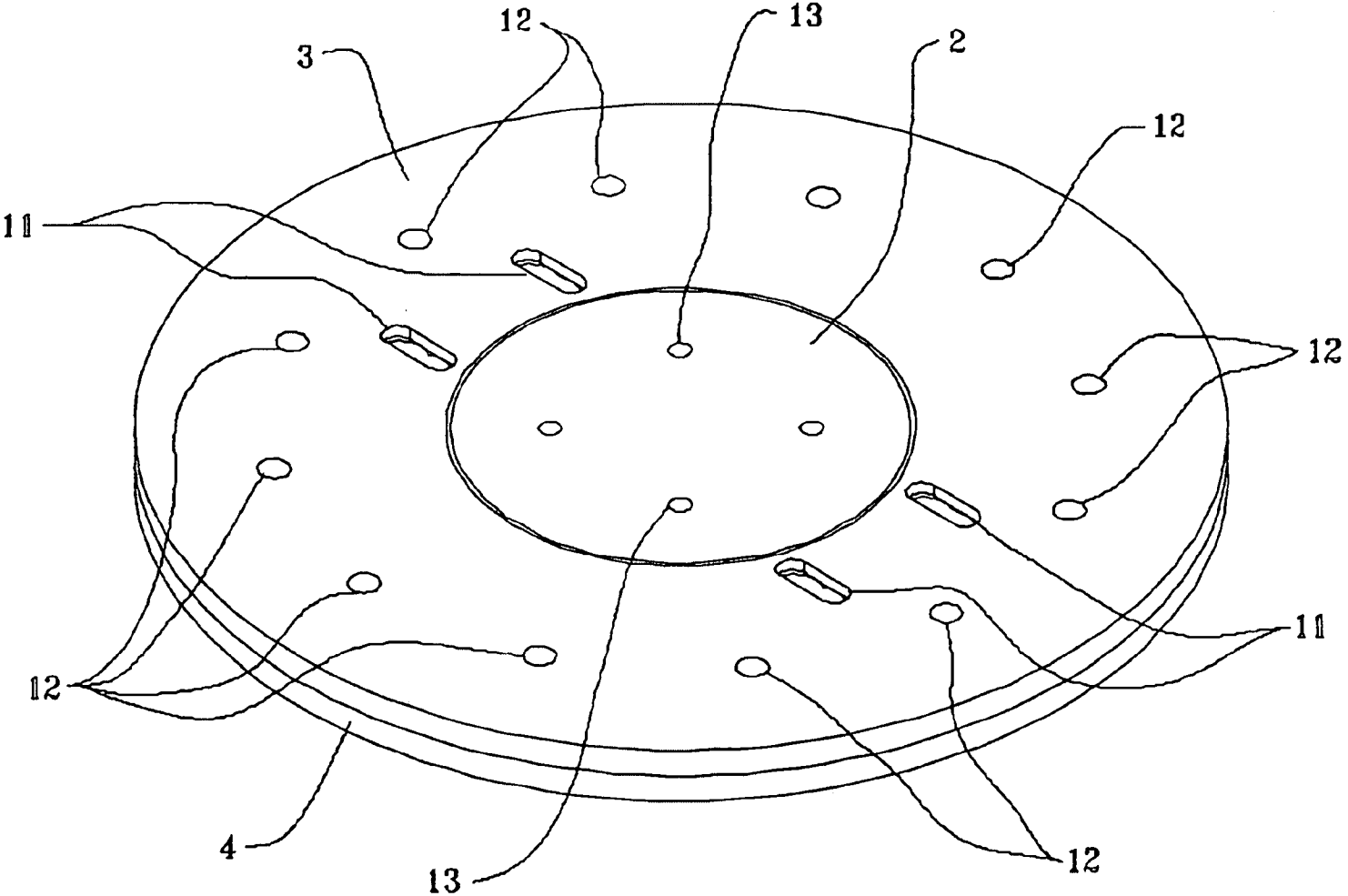
FIG. 3 is a bottom perspective view of the second circular plate and the first circular plate which is not visible in the top perspective view of FIG. 2.

As best seen in FIG. 1, a conventional snowboard 1 is shown with a conventional snowboard binding 14 which is mounted on top of the second circular plate 3 and third circular plate 4. A first circular plate 2 is shown in FIG. 3 nested inside second circular plate 3. Lock pins 6 are shown secured inside lock blocks 5. This entire assembly is utilized for securing and rotating the front foot. The hole pattern 10 is the conventional hole pattern used to mount conventional snowboard bindings. The first circular plate 2 and third circular 4 plates may be fastened together as a unit with screws 15 but in a preferred embodiment screws 15 will fasten the binding plate of the original or conventional non-rotatable boot binding 14 to the third and first circular plate to form a unitary rotatable assembly.

Figure 2:
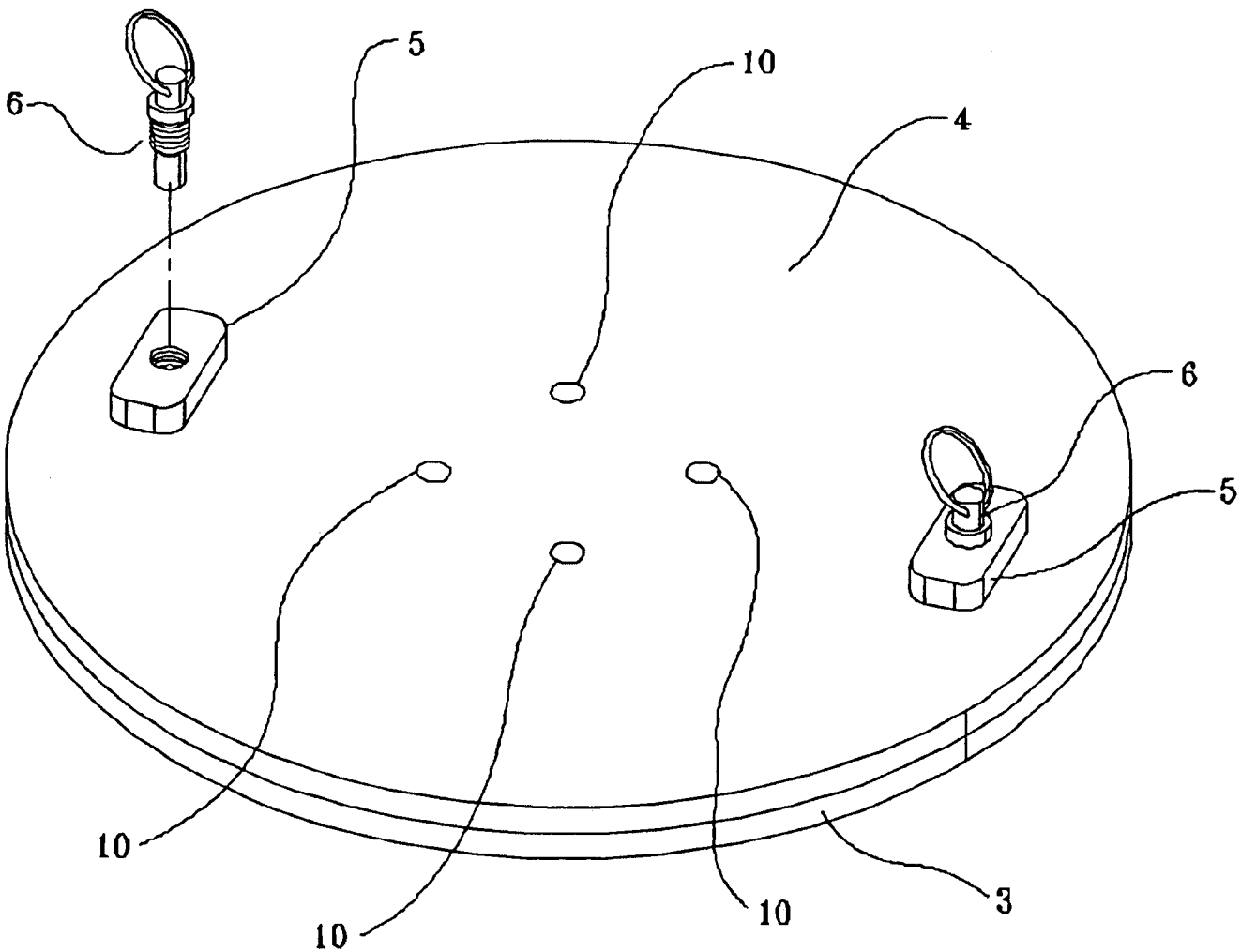
FIG. 2 is a top perspective view of an embodiment of the snowboard binding of the invention which shows the third circular plate mounted on top of the second circular plate with one of the locking elements withdrawn from its receiving hole and the other locking elements mounted in the hole in its lock block.

FIG. 2 is a top perspective view of the invention showing the second circular plate 3 which functions as the base mounting plate to hold the assembly rigidly to the snowboard 1. The third circular plate 4 is the binding mounting plate which is mounted on top of the second circular plate 3 and as shown has two lock blocks 5 and two lock pins 6 which are spring loaded to maintain the locking pins 6 in holes that are provided in the underlying second circular plate.

FIG. 3 is a bottom perspective view of the embodiment of FIG. 2 showing the swivel plate 2 which is not visible in FIG. 1 and FIG. 2. The swivel plate 2 is fitted inside the second circular plate 3 or base mounting plate 3 by means of the complimentary lower flange 19 and upper flange 18 which have been described previously. The indexing holes 12 are used to locate the lock pins 6 (shown in FIGS. 1 and 2) into pre-selected desirable positions for side forward or toe-forward use to determine the snowboarders foot position.

Figure 4:
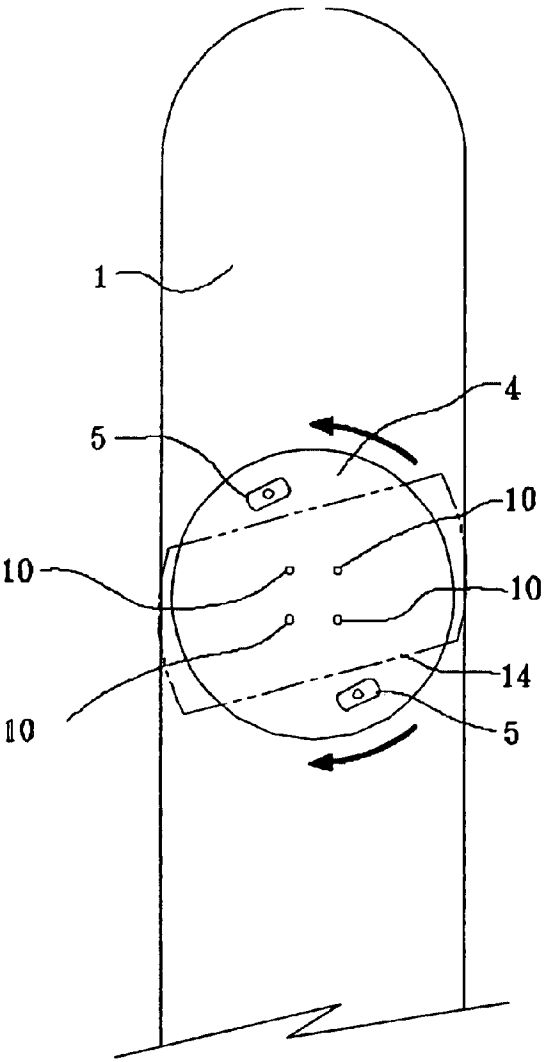
FIG. 4 is a top plan view of an embodiment of the present invention where the binding is mounted to the upper surface of a snowboard and is locked at the standard (transverse) riding position.

FIG. 4 illustrates a standard conventional transverse binding 14 position on snowboard 1.

Figure 5:
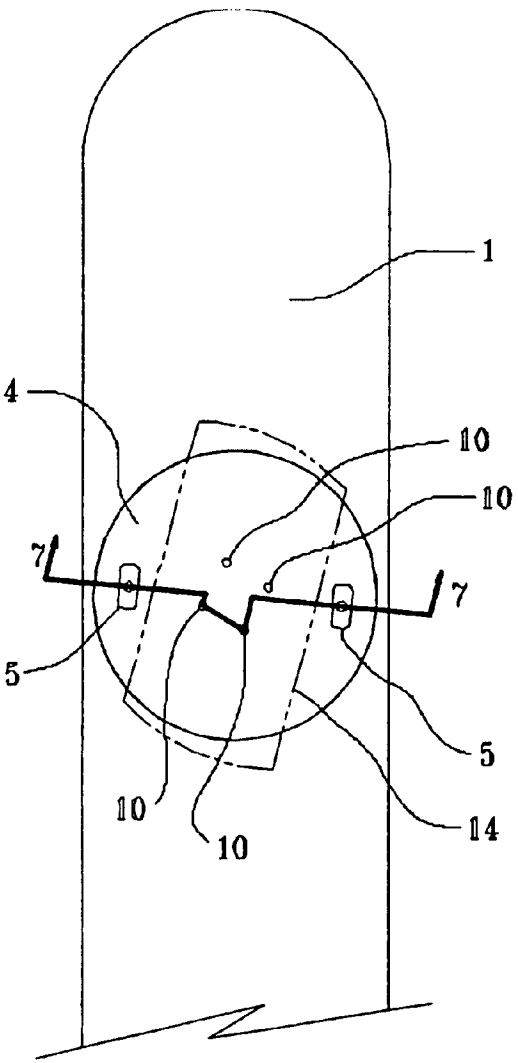
FIG. 5 is a top plan view of an embodiment of the invention where the binding is mounted to the upper surface of a snowboard and is locked in the toe-forward (longitudinal) position.

FIG. 5 illustrates the operation of the invention where the original binding 14 may swivel or rotate to a forward longitudinal position from a sideward position for facilitating the pushing of the snowboard on level surfaces.

Figure 8:
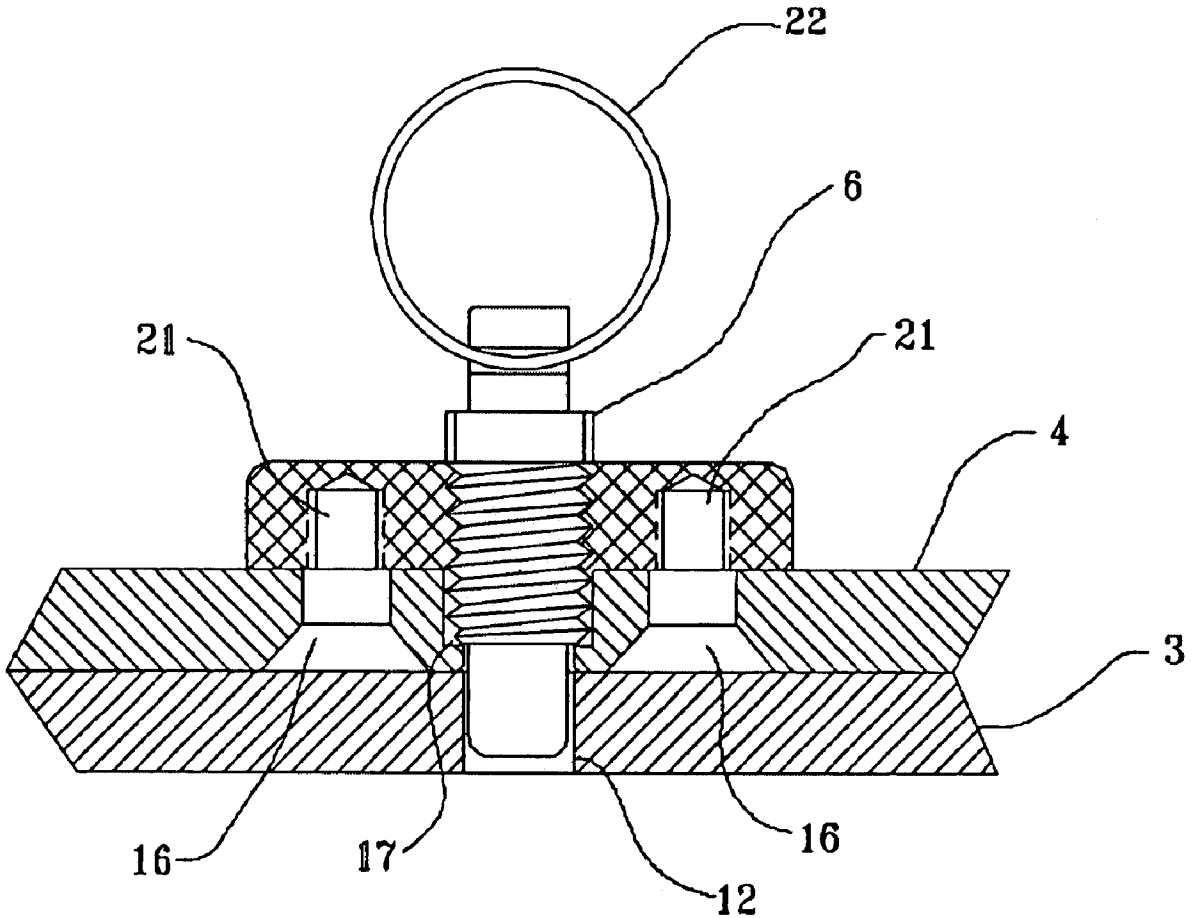
FIG. 8 is a cross-sectional view of the locking block that holds the locking mechanism which is attached to the third circular plate. A side view of the locking pin is shown with the locking pin in engagement with the second circular plate.

The exploded view of FIG. 6 illustrates the assembly of the invention. This assembly is located on the front boot position of the snowboard 1 as shown in FIG. 1. The snowboard 1 has two existing hole patterns 20 which are used for the front and rear bindings. These mounting holes are found on all conventional snowboards. The swivel plate 2 is centered on the snowboard 1 over the middle four holes 20. The lower flange 19 of the swivel plate 2 will temporarily touch the top surface of snowboard 1 when the first circular plate 2 and the second circular plate 3 are first positioned on a snowboard. Thereafter, the second circular or base mounting plate 3 is placed on top of the swivel plate 2 with the upper flange 18 to be mated with the lower flange 19 from the swivel plate 2. Slots 11 are then aligned over the outer holes 20 and the four screws 7 mount through the slots 11 and into the existing snowboard holes 20. Now the first circular plate or the swivel plate 2 can rotate or swivel freely inside the second circular or base mounting plate 3 which is now secured to the snowboard 1. Holes 13 are threaded to receive screws 15 when the third circular plate 3 is placed over the second circular plate 3 with holes 10 in register with holes 13. Screws 8 will go through the binding plate 4, countersunk clearance holes 16 and will screw into the threaded holes 21 of lock blocks 5. The lock pins 6 are then mounted into the lock blocks 5. This can be seen more clearly in FIG. 8. Pull rings 22 are mounted through the lock pins 6 and are used to disengage and engage the lock pins 6. Now the third circular or binding mounting plate 4 can be aligned on top of the second circular or base mounting plate 3 and the holes 13 of the first circular or swivel plate 2 are aligned with holes 10 of the third circular or binding mounting plate 4. The original or conventional non-rotatable boot binding 14, (shown in FIG. 1 by dotted lines) is mounted on top of the third circular plate 4 after aligning its original hole pattern with the binding mounting plate 4 clearance holes 10 and the swivel plate holes 13. Screws 15 can now secure the boot binding 14 to the binding plate 4 assembly through holes 10 and 13 of the first and third circular plates.

The lock pins 6 engage the second circular or base mounting plate 3 indexing holes 12 via through holes 17 in binding plate 4. A cord or leash 27 is attached to pull rings 22 which when pulled or released will engage or disengage the locking pins 6.

Figure 9:
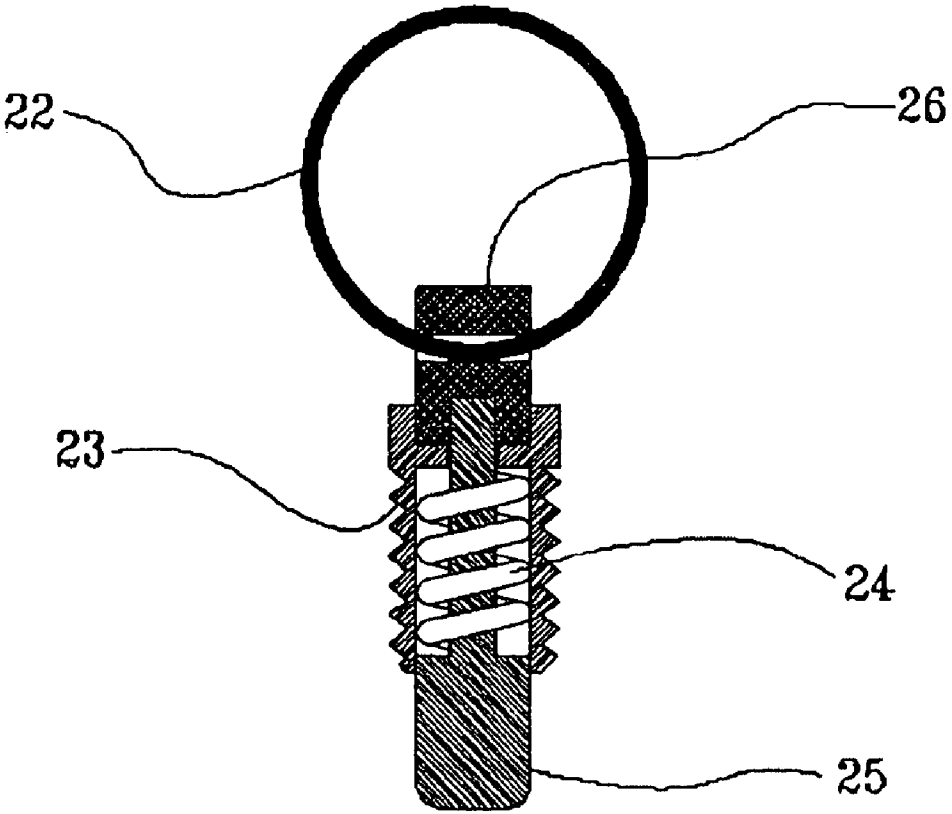
FIG. 9 is a cross-sectional view of the locking pin with the internal spring shown as a side view.

As best shown in FIG. 9, the locking mechanism assembly consists of a housing 23 having external threads that engage complimentary threads on the locking block 5. The housing 23 receives an upper pin 26 and lower pin 25. The lower pin 25 extends upward through a compression spring 24 which is inside the housing 23 and extends into and is mounted within the upper pin 26. A pull ring 22 is mounted in a transverse hole in upper pin 26.

While a preferred embodiment has been described, other variations and modifications will be obvious to those who are skilled in the art. Therefore it is intended that the appended claims will cover all such obvious modifications of the invention.

I claim:

1. A binding for affixing a boot to a snowboard, said binding being adapted to rotate between a plurality of fixed positions and having:

(a) a first circular plate having an upper surface and a lower surface and having a plurality of holes between said top surface and said bottom surface which are sized to engage fasteners, said first circular plate having on said upper surface a section of reduced thickness adjacent to an outer circular edge which defines a relatively thicker central section of said first circular plate;

(b) a second circular plate adapted to be fastened to the surface of said snowboard, said second circular plate having an upper surface and a lower surface and a centrally located hole that is sized to receive said first circular plate and having next to said centrally located hole, a section of reduced thickness on its lower surface which is sized to engage the section of reduced thickness on said first circular plate while allowing rotation of said first circular plate relative to said second circular plate;

(c) a third circular plate having a diameter which is substantially the same as the diameter of said second circular plate, said third circular plate having a plurality of holes which may be positioned to be in register with said plurality of holes in said first circular plate, said third circular plate having means to releasably engage stopping means on the upper surface of said second circular plate to allow for selection of a plurality of positions of said third plate relative to a longitudinal axis of said snowboard; and (d) means for fastening said first circular plate to said third circular plate wherein the means for releasably engaging stopping means on said third circular plate comprise spring loaded pins.

2. A binding for affixing a boot to a snowboard as defined in claim 1 wherein said means for fastening said first circular plate to said third circular plate are adapted to also fasten a boot binding to said first circular plate and said third circular plate.

3. A binding for affixing a boot to a snowboard as defined in claim 2 wherein said stopping means comprise a plurality of drilled holes in said second circular plate.

4. A binding for affixing a boot to a snowboard as defined in claim 2 wherein said stopping means comprise a plurality of depressions in said second circular plate.

5. A binding for affixing a boot to a snowboard as defined in claim 1 wherein said means to releasably engage stopping means on the upper surface of said second circular plate to allow for selection of a plurality of positions comprises one or more spring loaded pins which engage one or more of a plurality of stopping means on said second circular plate.

6. A binding for affixing a boot to a snowboard as defined in claim 5 wherein said means to releasably engage stopping means comprise two vertically arranged spring loaded pins which are connected together with cord means which allow for simultaneous withdrawal of two pins with one motion of one hand.

7. A binding for affixing a boot to a snowboard as defined in claim 6 wherein two spring loaded pins are provided at locations which are about 180° apart on the outer periphery of the upper surface of said third circular plate.

8. A binding for affixing a boot to a snowboard said binding being adapted to rotate between a plurality of fixed positions and having:

(a) a first circular plate having an upper surface and a lower surface and having a plurality of holes between said top surface and said bottom surface which are sized to engage fasteners, said first circular plate having on said upper surface a section of reduced thickness adjacent to an outer circular edge which defines a relatively thicker central section of said first circular plate;

(b) a second circular plate adapted to be fastened to the surface of said snowboard, said second circular plate having an upper surface and a lower surface and a centrally located hole that is sized to receive said first circular plate and having next to said centrally located hole, a section of reduced thickness on its lower surface which is sized to engage the section of reduced thickness on said first circular plate while allowing rotation of said first circular plate relative to said second circular plate;

(c) a third circular plate having a diameter which is substantially the same as the diameter of said second circular plate, said third circular plate having a plurality of holes which may be positioned to be in register with said plurality of holes in said first circular plate, said third circular plate having means to releasably engage stopping means on the upper surface of said second circular plate to allow for selection of a plurality of positions of said third plate relative to a longitudinal axis of said snowboard; and (d) means for fastening said first circular plate to said third circular plate wherein said second circular plate has a plurality of recessed holes adapted to engage fasteners for substantially permanent mounting of said plate on said snowboard.

9. A binding for affixing a boot to a snowboard as defined in claim 8 wherein said recessed holes comprise slots that allow for the placing of fasteners in said snowboard in more than one position.

* * * * *